US006203132B1

(12) United States Patent
Tsukada et al.

(10) Patent No.: US 6,203,132 B1
(45) Date of Patent: Mar. 20, 2001

(54) INK JET RECORDING APPARATUS

(75) Inventors: Kenji Tsukada; Munehide Kanaya; Takahiro Katakura, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/024,182

(22) Filed: Feb. 17, 1998

(30) Foreign Application Priority Data

Feb. 17, 1997 (JP) ..... 9-032485
Jan. 30, 1998 (JP) ..... 10-034204

(51) Int. Cl.[7] ..... B41J 29/38
(52) U.S. Cl. ..... 347/11; 347/60; 347/15
(58) Field of Search ..... 347/10, 15, 60, 347/11, 17, 14

(56) References Cited

U.S. PATENT DOCUMENTS

| | | | | |
|---|---|---|---|---|
| 4,275,402 | | 6/1981 | Kern | 346/140 R |
| 4,686,539 | * | 8/1987 | Schmidle et al. | 347/15 |
| 4,860,034 | | 8/1989 | Watanabe et al. | 346/140 R |
| 5,264,865 | * | 11/1993 | Shimoda et al. | 347/11 |
| 5,541,628 | * | 7/1996 | Chang et al. | 347/10 |
| 5,610,637 | * | 3/1997 | Sekiya et al. | 347/15 |

FOREIGN PATENT DOCUMENTS

| | | | |
|---|---|---|---|
| 36 12 469 | 10/1986 | (DE) | B41J/3/04 |
| 0 646 461 | 4/1995 | (EP) | B41J/2/045 |
| 09309206 | 12/1997 | (JP) . | |

OTHER PUBLICATIONS

Patent Abstracts of Japan vol. 018, No. 526(M–1683), Oct. 5, 1994 & JP 06 182997 A (Seiko Epson Corp) Jul. 5, 1994 *Abstract.

Patent Abstracts of Japan vol. 002, No. 130(E–068), Oct. 28, 1978 & JP 53 098826 A (Hitachi Ltd), Aug. 29, 1978 *Abstract.

"Temperature Compensation for Drop–On–Demand Drop Velocity" IBM Technical Disclosure Bulletin, vol. 30, No. 7, Dec. 7, 1987, pp. 85–87, XP000021744.

* cited by examiner

*Primary Examiner*—David F. Yockey
*Assistant Examiner*—Charles W. Stewart, Jr.
(74) *Attorney, Agent, or Firm*—Sughrue, Mion, Zinn, Macpeak & Seas, PLLC

(57) ABSTRACT

Driving signal generating member for generating a first signal for drawing as meniscus at a nozzle aperture by smaller force as ambient temperature rises, a second signal for contracting a pressure generating chamber and ejecting an ink droplet and a third signal for restoring the contracted pressure generating chamber after an ink droplet is ejected by larger drawing force as ambient temperature rises is provided, speed at which the meniscus is moved toward the nozzle aperture is prevented from decreasing by setting force for drawing the meniscus before an ink droplet is ejected when temperature falls to a large value and the delay of filling the pressure generating chamber with ink is prevented by setting force for drawing the meniscus after an ink droplet is ejected to a small value and damping the residual vibration of the meniscus utilizing attenuation by increasing the viscosity of ink.

8 Claims, 9 Drawing Sheets

INK JET RECORDING APPARATUS

BACKGROUND OF THE INVENTION

1. Field of the Invention

The present invention relates to an ink jet recording head using a piezoelectric vibrator as a driving source.

2. Related Art

There has been known a conventional ink jet recording head for sucking ink and ejecting ink droplets by expanding or contracting a pressure generating chamber partly constituted by an deformable plate which communicates with a nozzle aperture by a piezoelectric vibrator. The conventional ink jet recording head suffers from a problem that the quantity of ink in a ejected ink droplet is greatly influenced by the change of the viscosity due to the change of temperature because an ink droplet is ejected by pressure. That is, the quantity of ink increases as temperature rises as shown in FIG. 16 and the quality of printing is varied.

In view of the afore-mentioned problem, there has been proposed a driving technique for fixing the quantity of ink by changing the rate of the contraction of a pressure generating chamber according to ambient temperature and adjusting the magnitude of a signal applied to a piezoelectric vibrator and variable acceleration when an ink droplet is ejected to temperature.

Hereby, the quantity of ink in an ink droplet can be held so that it is fixed independent of temperature by changing the level of a signal applied to a head according to temperature. However, as the speed and quantity of the contraction of a pressure generating chamber come to vary, the speed and stability of the ejecting of ink droplets are readily deteriorated particularly in printing requiring the formation of a minute dot such as graphic data. Therefore, there still arises a problem that the speed of the ejecting of ink droplets is deteriorated and unstable and the quality and the stability of printing are deteriorated.

To solve such deficiency, there has been proposed, as disclosed in Unexamined Japanese Patent Application No. Hei. 9-309206, another ink jet recording apparatus which is provided with an ink jet recording head made of nozzle apertures, a pressure generating chamber communicating with a common ink chamber via an ink supply port and a piezoelectric vibrator for expanding or contracting the pressure generating chamber and signal generating means for generating a first signal for expanding the pressure generating chamber depending upon the change of potential from intermediate potential at which voltage from reference potential varies depending upon temperature to the reference potential, a second signal generated for raising the potential from the reference potential to the maximum voltage for contracting the pressure generating chamber to eject an ink droplet and a third signal for restoring the contracted pressure generating chamber after an ink droplet is ejected for holding the weight of an ink droplet and the speed of ejection fixed independent of temperature by setting the intermediate potential to a higher value when temperature rises.

However, such proposed apparatus still causes another problem that it is difficult to control the position of a meniscus based upon temperature, that is, the viscosity of ink.

Therefore, there is a problem that a range in which the quantity of ink in an ink droplet which can eject in stable is adjusted is small and, particularly, it is difficult to form a small dot suitable for graphic printing independent of temperature.

SUMMARY OF THE INVENTION

The present invention was made in view of such difficulties and it is an object of the invention to provide an ink jet recording apparatus which enables forming stably a dot in minute size by relatively simple control.

Another object of the present invention is to provide an ink jet recording apparatus which enables forming stably dots in plural sizes.

The foregoing and other objects can be achieved by a provision of an ink jet recording head which, according to the present invention, includes nozzle apertures, a pressure generating chamber communicating with a common ink chamber and pressure generating member for expanding or contracting the pressure generating chamber and driving signal generating member for generating a first signal for drawing a meniscus at the nozzle apertures in by small force as ambient temperature rises, a second signal for contracting the pressure generating chamber and ejecting ink droplets and a third signal for restoring the contracted pressure generating chamber by large drawing force as ambient temperature rises after ink droplets eject.

The delay of filling the pressure generating chamber with ink is prevented by preventing the speed of the movement of a meniscus to a nozzle aperture from being reduced by increasing force for drawing the meniscus before ink droplet is ejected in when temperature falls and preventing the residual vibration of the meniscus utilizing attenuation due to increasing the viscosity of ink by reducing force for drawing the meniscus after an ink droplet is ejected in.

PREFERRED EMBODIMENTS OF THE INVENTION

Preferred embodiments of the present invention will now be described below with reference to accompanying drawings.

Figure 1:
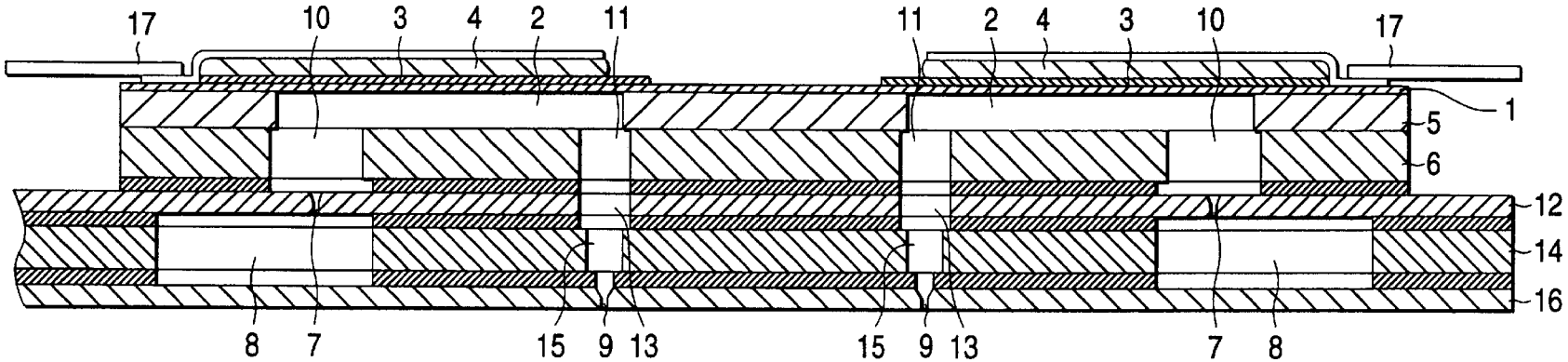
FIG. 1 is a sectional view showing an embodiment of an ink jet recording head used for an ink jet recording apparatus according to the present invention.

FIG. 1 shows an embodiment of an ink jet recording head to which the present invention is applied and the structure of the vicinity of a pressure generating chamber in one actuator unit.

As shown in FIG. 1, a first cover 1 is constituted by a thin plate made of zirconia ($ZrO_2$) approximately 9 $\mu$m thick, driving electrodes 3 are formed on the surface so that the electrodes are respectively opposite to pressure generating chambers 2 and piezoelectric vibrators 4 made of PZT and others are respectively fixed to the surface.

A spacer 5 is constituted by making a through hole in a ceramic plate with thickness suitable to form each pressure generating chamber 2, 150 $\mu$m thick for example such as zirconia and forms each pressure generating chamber 2 with its both faces sealed by a second cover 6 described later and the first cover 1. Each pressure generating chamber 2 is expanded or contracted by the flexural oscillation of each piezoelectric vibrator 4, absorbs ink in each common ink chamber 8 via each ink supply port 7 and ejects ink droplets from each nozzle aperture 9.

The second cover 6 is constituted by making holes 10 communicating with a nozzle which communicate with each nozzle aperture at end of each pressure generating chamber 2 on the opposite side and communicating holes 11 respectively communicating with the ink supply ports 7 outside in a ceramic plate such as zirconia.

An ink supply port forming substrate 12 is constituted by making holes 13 communicating with a nozzle connected to each nozzle aperture 9 on the central side of each pressure generating chamber 2 and the above ink supply ports 7 for connecting and the above ink supply ports 7 for respectively connecting the common ink chambers 8 and the pressure generating chambers 2 outside.

A common ink chamber forming substrate 14 is constituted by making communicating holes respectively corresponding to the form of the common ink chambers 8 and communicating holes 15 respectively communicating with the nozzle apertures 9 outside in a plate provided with corrosion resistance and rigidity such as stainless steel with the thickness suitable to form the common ink chambers 8, for example 150 $\mu$m thick.

A nozzle plate 16 is constituted by forming plural rows of nozzle apertures 9, in two rows in this embodiment. A flexible cable 17 respectively supplies a signal from an external circuit to the piezoelectric vibrators 4.

Figure 2:
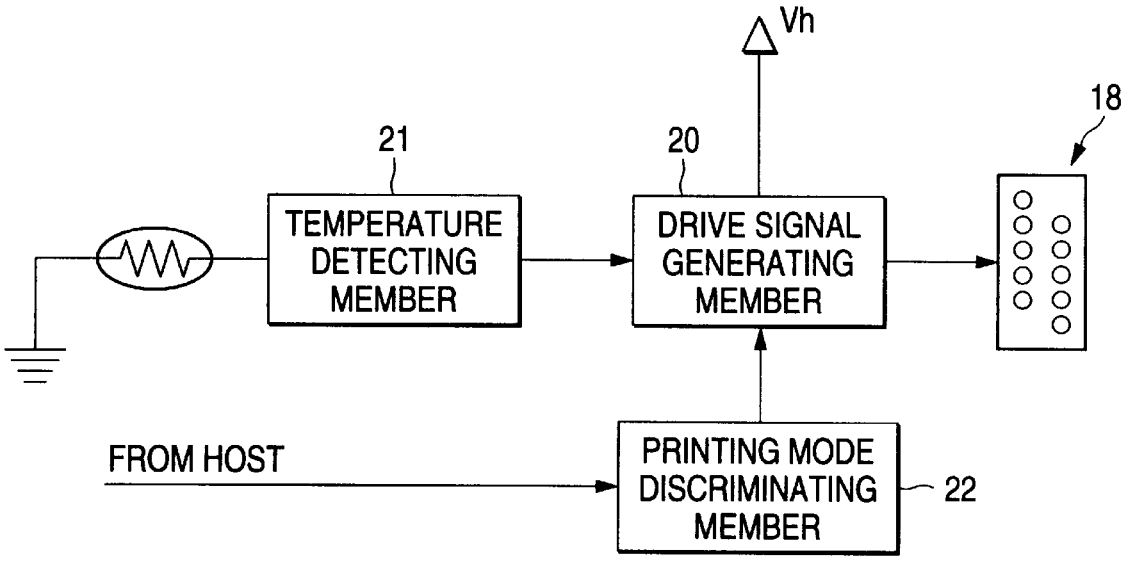
FIG. 2 is a block diagram showing an embodiment of signal generating means according to the present invention.
Figure 3:
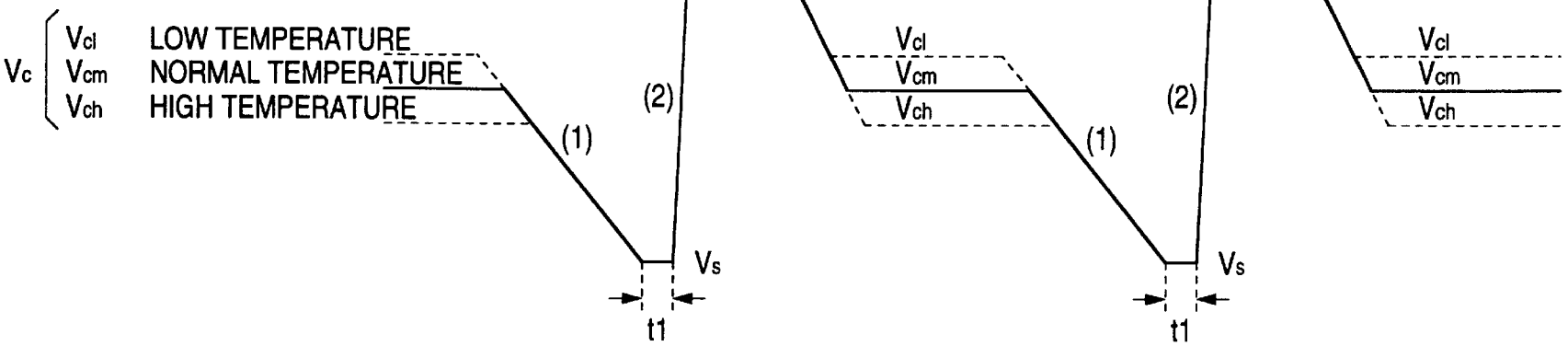
FIG. 3 is a waveform drawing showing an embodiment of a signal in the ink jet recording apparatus.

FIG. 2 shows one example of a drive unit for driving the above head 18. A driving signal generating member 20 generates a first signal (1), a second signal (2) and a third signal (3) shown in FIG. 3. The first signal (1) performs to lower the potential from intermediate potential Vc to the reference potential Vs. As shown in FIG. 3, the potential difference between the intermediate potential Vc and the reference potential Vs is changed by temperature detecting member 21 described later. The second signal (2) is generated for raising the potential from the reference potential Vs to the maximum potential Vh for ejecting ink droplets. The third signal (3) is generated for lowering the potential from the maximum potential Vh to the intermediate potential Vc for expanding the contracted pressure generating chamber 2 until it is restored and filling the pressure generating chamber 2 with ink from the common ink chamber 8.

The maximum potential Vh and the intermediate potential Vc are controlled based upon temperature reported from the temperature detecting means 21 and the maximum potential Vh is adjusted to a dot to be formed by printing mode discriminating means 22.

The intermediate potential Vc is set, as shown in FIG. 3, so that the intermediate potential is lower as outside air temperature rises, that is, it is a higher value Vc1 than a value Vcm at ordinary temperature when outside air temperature is low and so that the intermediate potential is a lower value Vch than at ordinary temperature when outside air temperature is high. The intermediate potential Vcm at ordinary temperature is set so that it is the quantity of ink in a droplet is an optimum value for printing.

Figure 4:
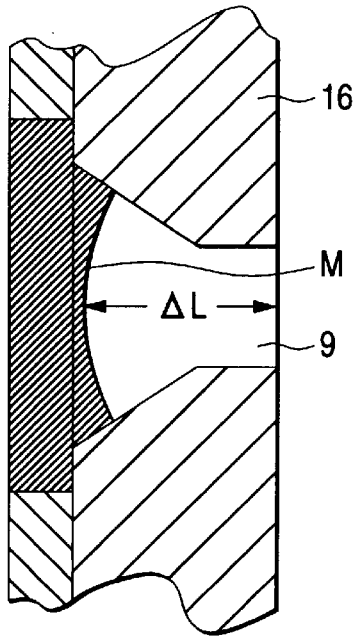
FIG. 4 shows the behavior of a meniscus in the vicinity of a nozzle aperture.

In such constitution, when a printing signal is input from an external device, the piezoelectric vibrator 4 charged at the intermediate potential Vc beforehand discharges according to the first signal (1), that is, by potential difference between the intermediate potential Vc and the reference potential Vs and expands the pressure generating chamber 2 by quantity equivalent to the intermediate potential Vc. Hereby, a meniscus is drawn in on the side of the pressure generating chamber 2 by quantity L equivalent to the quantity in which the pressure generating chamber is expanded from the nozzle aperture 9 as shown in FIG. 4.

When the application of the first signal (1) is completed and predetermined time t1 elapses, the second signal (2) for raising the potential from the reference potential Vs to the maximum potential Vh is output, the piezoelectric vibrator 4 is charged and the pressure generating chamber 2 is contracted.

When the second signal (2) is applied, the direction of the movement of a meniscus once drawn in on the side of the pressure generating chamber 2 by the first signal (1) is inverted on the side of the nozzle aperture and the meniscus is returned to a position suitable for printing. As of course, the quantity of ink in an ink droplet greatly depends upon distance $\Delta L$ shown in FIG. 4 between the meniscus and the nozzle aperture, an ink droplet with the quantity of ink adjusted to the distance L is ejected from the nozzle aperture toward a recording medium at speed based upon potential difference between the reference potential Vs and the maximum potential Vh. The distance $\Delta L$ can be freely set by adjusting time t1 from time at which the potential is lowered to the reference potential Vs by the first signal (1) till time at which the second signal (2) is applied.

After an ink droplet is ejected, the third signal (3) generated for lowering the potential from the maximum potential Vh to the intermediate potential Vc is applied to the piezoelectric vibrator 4 and the pressure generating chamber 2 is expanded by quantity equivalent to the potential difference "Vh–Vc" by discharging the piezoelectric vibrator 4. Hereby, a meniscus which starts to be vibrated in the nozzle aperture together with the ejecting of an ink droplet is drawn back on the side of the pressure generating chamber.

As the expansion of the pressure generating chamber 2 simultaneously draws ink into the pressure generating chamber 2 from the common ink chamber 8 via the ink supply port 7, the meniscus being drawn back on the side of the pressure generating chamber is promptly returned to the nozzle aperture 9 by the above drawing in of ink without being drawn excessively.

After the application of the third signal (3) is completed, the piezoelectric vibrator 4 is ready for next printing with it charged at the intermediate potential Vc. The above processes are repeated and ink droplets are ejected.

If outside air temperature falls from ordinary temperature, the driving signal generating member 20 sets the intermediate potential vc based upon a signal from the temperature detecting member 21 so that the intermediate potential Vc has a higher value Vc1 than the intermediate potential Vcm at ordinary temperature.

When a printing signal is input in the above state, the first signal (1) for lowering the potential from the intermediate potential Vc1 set so that the intermediate potential Vc1 is higher than the intermediate potential at ordinary temperature to the reference potential Vs is applied to the piezoelectric vibrator 4 and the pressure generating chamber 2,is expanded so that it has larger volume than at the normal temperature.

Hereby, even if the viscosity of ink in the pressure generating chamber 2 and at the nozzle aperture 9 increases because temperature falls, a meniscus is drawn on the side of the pressure generating chamber by stronger force than at the normal temperature, the increased quantity of fluid resistance due to the increase of the viscosity is offset and the drawn quantity from the nozzle aperture 9 is approximately equal to quantity at the normal temperature.

When predetermined time t1 elapses, the driving signal generating member 20 outputs the second signal (2) for raising the potential from the reference potential Vs to the maximum potential Vh so as to contract the pressure generating chamber 2. At this time, as the meniscus once drawn into the pressure generating chamber 2 moves toward the nozzle aperture 9 and reaches a position suitable for printing, an ink droplet with the quantity of ink adjusted to the distance ΔL between the meniscus and the nozzle aperture 2 is ejected and therefore, the ink droplet is ejected toward a recording medium at approximately the same speed as speed at ordinary temperature. Hereby, an ink droplet is ejected toward a recording medium with the same positional precision as at ordinary temperature and forms a dot without being blurred due to the variation of speed and others.

When the application of the second signal (2) is completed and predetermined time t2 elapses, the driving signal generating member 20 outputs the third signal (3) for lowering the potential from the maximum potential Vh to the intermediate potential Vc1 to the piezoelectric vibrator 4. As described above, as the intermediate potential Vc1 is set so that it is higher than the intermediate potential Vcm at ordinary temperature when temperature is low, the potential difference by the third signal (3) is smaller than at ordinary temperature and therefore, the quantity of the expansion of the pressure generating chamber 2 is also reduced than at the normal temperature.

Hereby, force for drawing a meniscus at the nozzle aperture 9 on the side of the pressure generating chamber is smaller than at ordinary temperature and the residual vibration of the meniscus is promptly damped because of the increase of fluid resistance by the increase of the viscosity of ink without drawing the meniscus the viscosity of which increases because temperature falls into the pressure generating chamber 2 in vain.

As pressure by the expansion of the pressure generating chamber 2 integrally acts on the ink supply port 7 by the prompt static stoppage of the meniscus, ink in the common ink chamber 8 promptly flows into the pressure generating chamber 2 via the ink supply port 7 and the pressure generating chamber 2 is securely and promptly filled with ink in quantity required for next printing.

The above replenishment of the pressure generating chamber 2 with ink for a short time is extremely effective to execute high-speed printing in a printing mode in which multiple minute dots such as graphic data particularly are required to be printed in high density.

That is, when next printing operation is started in a state in which the pressure generating chamber 2 is not sufficiently replenished with ink, there is a problem that not only the quantity of ink in an ink droplet decreases but ejecting speed rapidly decreases due to the deterioration of inertial force due to the decrease of the weight of an ink droplet, ejected position disperses and printing quality is deteriorated.

To solve such a problem, normally, the pressure generating chamber 2 has only to be let alone until it is filled with ink, however, a cycle in which a driving signal for ejecting an ink droplet is applied is extended and printing speed is decreased.

In the meantime, if outside air temperature is high and the viscosity of ink is deteriorated, compared with that at the normal temperature, the driving signal generating member 20 sets the intermediate potential Vc to a lower value Vch than at ordinary temperature based upon a signal from the temperature detecting member 21. When a printing signal is input in this state, the first signal (1) from the driving signal generating member 20 is applied to the piezoelectric vibrator 4 charged to the intermediate potential Vch beforehand. Hereby, the pressure generating chamber 2 is expanded so that it has smaller volume than at ordinary temperature.

In the meantime, as the viscosity of ink is decreased due to high temperature and the fluid resistance of a meniscus decreases, the meniscus is drawn on the side of the pressure generating chamber to the same degree as at the normal temperature though the pressure generating chamber 2 is expanded smaller.

When predetermined time t1 elapses, the driving signal generating member 20 outputs the second signal (2) for raising the potential from the reference potential Vs to the maximum potential Vh, contracts the pressure generating chamber 2 and ejects an ink droplet from the nozzle aperture 9.

The meniscus after the ink droplet is ejected is vibrated at large amplitude by quantity in which the viscosity decreases. The driving signal generating member 20 outputs the third signal (3) when predetermined time elapses, that is, the meniscus is inverted on the side of the nozzle aperture. As the third signal (3) is related to potential difference between the intermediate potential Vch set so that it is lower than at ordinary temperature and the maximum potential Vh, the pressure generating chamber 2 is expanded when the meniscus directed toward the nozzle aperture 9 is drawn in so that the pressure generating chamber is larger than at ordinary temperature. Hereby, the meniscus directed toward the nozzle aperture 9 is drawn on the side of the pressure generating chamber by strong force, the vibration is securely damped and a satellite is securely prevented from being generated in the meniscus with large amplitude.

That is, as the quantity of the expansion of the pressure generating chamber 2 after an ink droplet is ejected is adjusted by changing the intermediate potential Vc corresponding to ambient temperature, that is, the viscosity of ink and next printing is prepared by adjusting the amplitude of the residual vibration of the meniscus and force for drawing the meniscus in corresponding to the viscosity of ink, an ink droplet can be stably ejected without generating a satellite independent of the change of temperature.

An example of the operation of the recording apparatus according to the present invention in case the quantity of ink in an ink droplet, that is, the size of a dot is changed and the selected size is held independent of the change of temperature will be further described.

Figure 5:
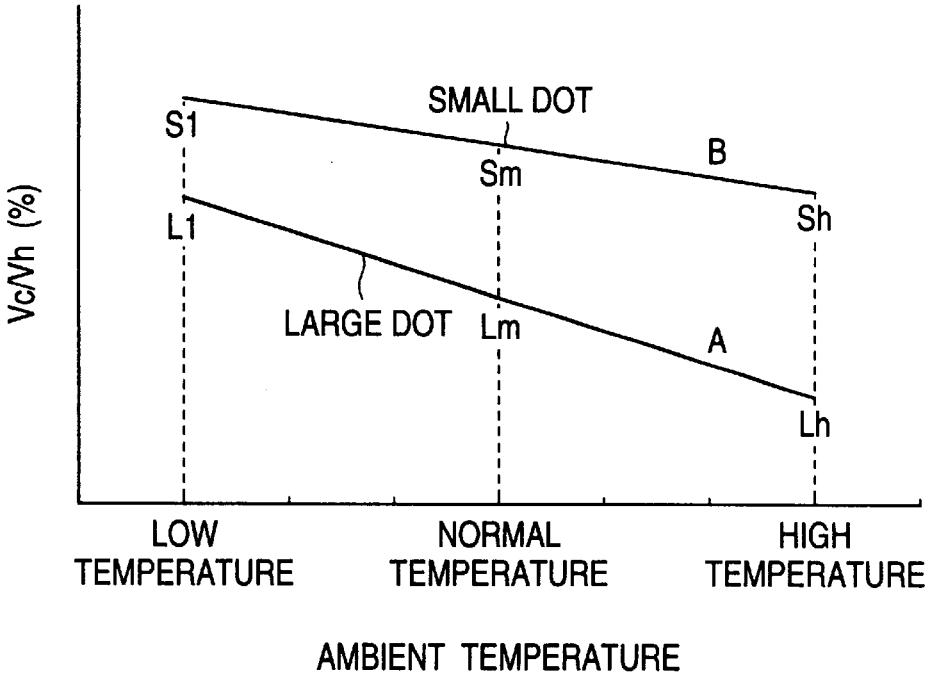
FIG. 5 is a chart showing relationship between outside air temperature and intermediate potential Vc using dot size to be formed as a parameter.

FIG. 5 shows the ratio of the intermediate potential Vc depending upon temperature in a driving signal set by the driving signal generating means 20 to the maximum potential Vh using dot size as a parameter.

If a large dot is to be formed as shown by A in FIG. 5, the degree (the incline) of the change of the intermediate potential Vc for temperature is set so that it is large and if a small dot is to be formed as shown by B in FIG. 5, the degree (the incline) of the change of the intermediate potential Vc for temperature is set so that it is small. The value of the intermediate potential Vc if a large dot is to be formed is set so that it is lower than if a small dot is to be formed.

A driving signal output from the driving signal generating member 20 is controlled by the printing mode discriminating means 22 so that the recording apparatus is operated in a printing mode specified by a printing signal input from an external device.

Figure 6:
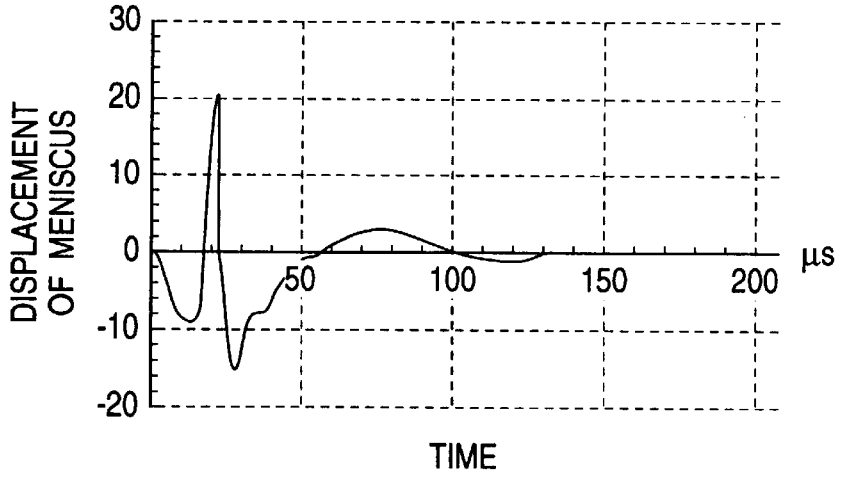
FIG. 6 is a chart showing the displacement of the meniscus when temperature is low in case a large dot is formed in the ink jet recording apparatus.
Figure 7:
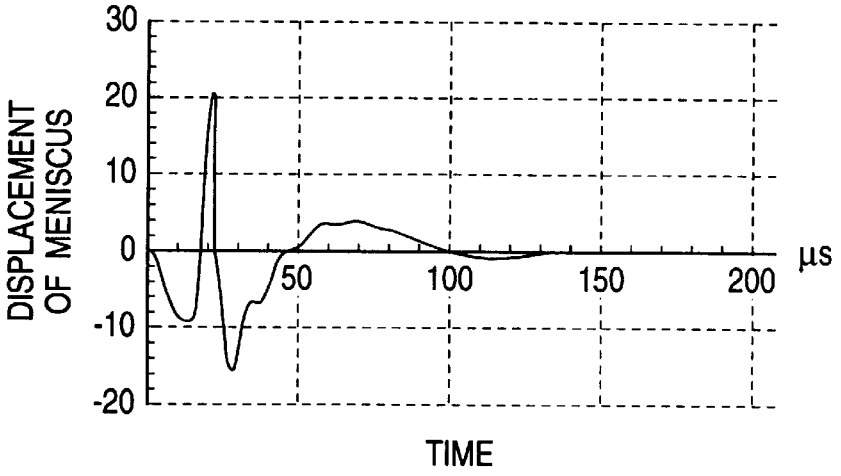
FIG. 7 is a chart showing the displacement of the meniscus at the normal temperature in case a large dot is formed in the ink jet recording apparatus.
Figure 8:
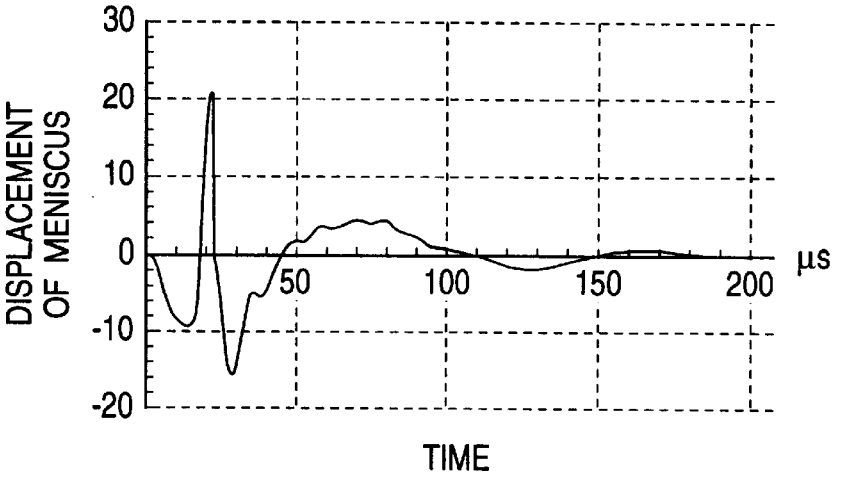
FIG. 8 is a chart showing the displacement of the meniscus when temperature is high in case a large dot is formed in the ink jet recording apparatus.

As described above, as potential difference between the reference potential Vs and the intermediate potential Vc is set to a small value and the degree of the change for temperature is set to a large value by individually setting the magnitude of the intermediate potential Vc and the degree of the change for temperature according to the size of a dot to be formed in case an image is printed by large dots, the meniscus after an ink droplet is ejected can be promptly returned on the side of the nozzle aperture and the pressure generating chamber 2 can be promptly filled with ink as shown in FIG. 6 when temperature is low and the large vibration of the meniscus after an ink droplet is ejected can be securely damped as shown in FIG. 8 when temperature is high. FIG. 7 shows the motion of the meniscus at ordinary temperature.

Figure 14:
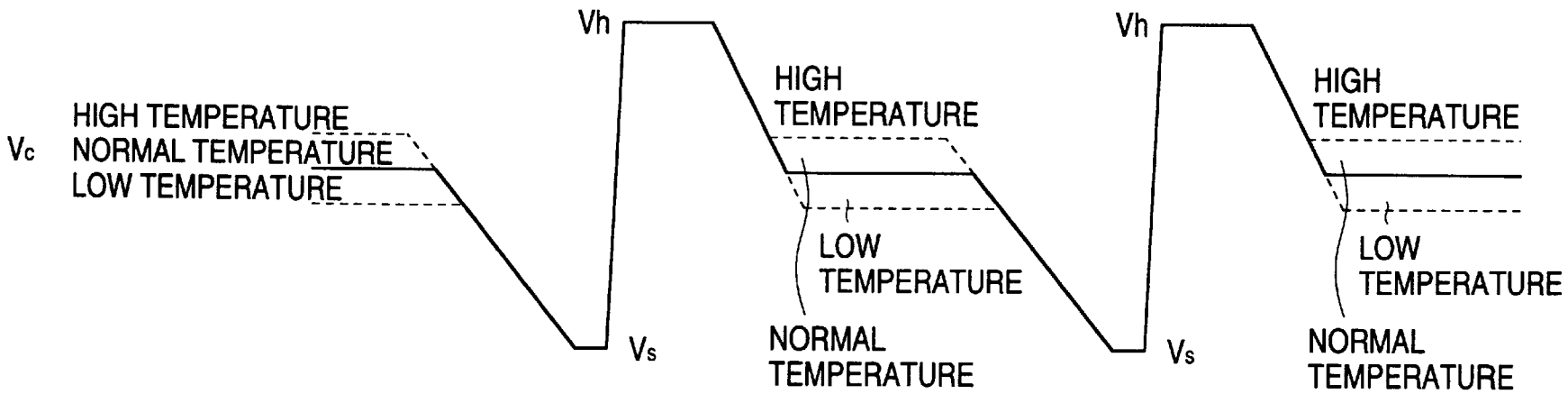
FIG. 14 is a waveform drawing showing the driving method of a conventional type ink jet recording apparatus.
Figure 15A:
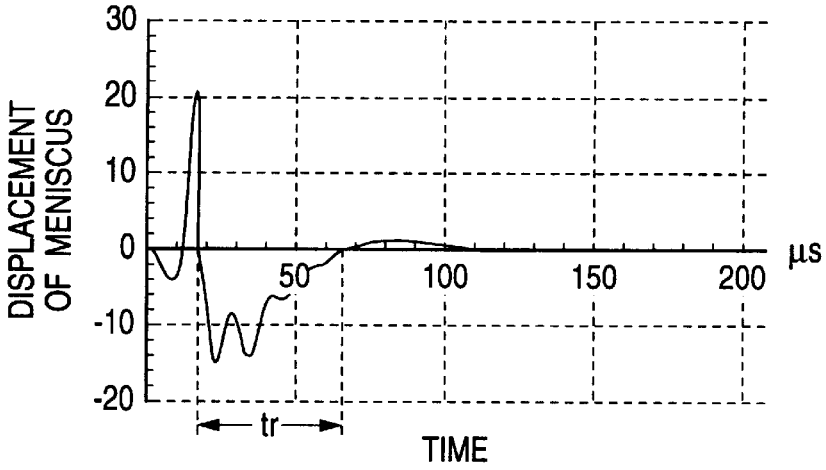
FIGS. 15A and 15B respectively show the displacement of the meniscus when temperature is low and when temperature is high by a conventional type driving method.

In the meantime, if the intermediate potential Vc is adjusted to a low value corresponding to temperature when temperature is low and adjusted to a high value when temperature is high as in a conventional type driving method shown in FIG. 14, time tr in which the meniscus after an ink droplet is ejected is returned is extended as shown in FIG. 15A when temperature is low and printing speed decreases.

Figure 15B:
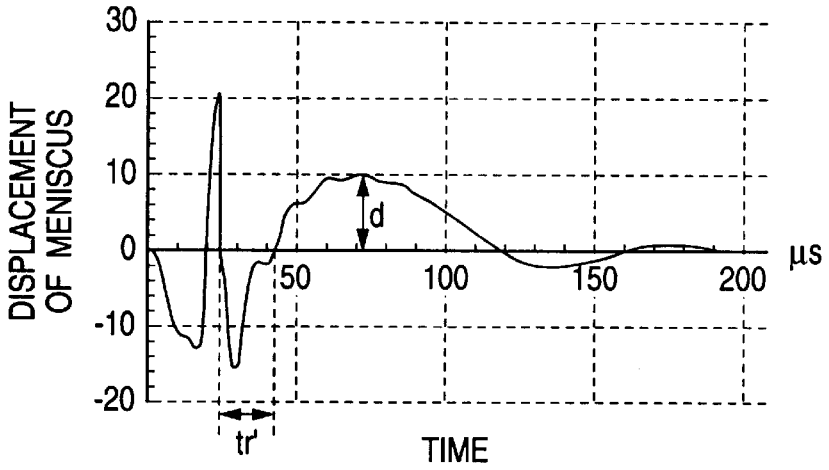
Figure 16:
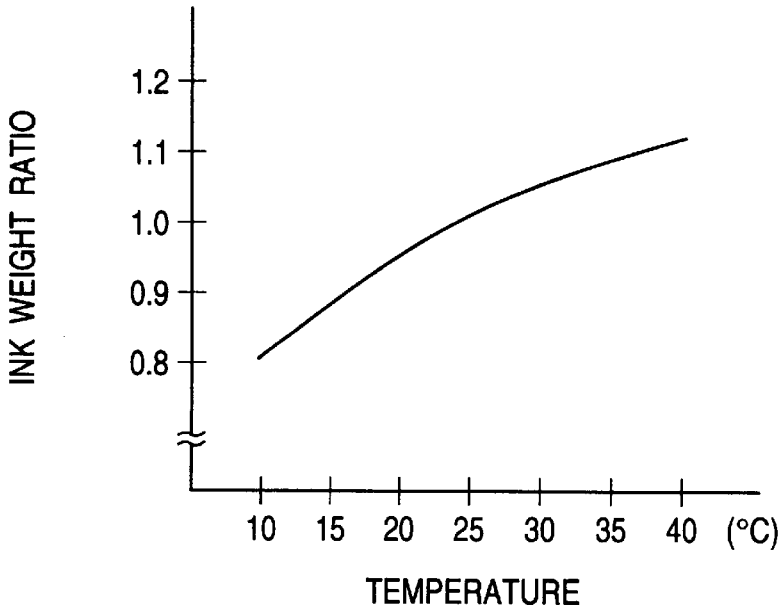
FIG. 16 is a graph showing a variation of ink weight with respect to ink temperature.

When temperature is high, the returned time tr' is reduced as shown in FIG. 15B, however, the quantity d in which the meniscus protrudes from the nozzle aperture increases and a problem that an unnecessary ink droplet such as a satellite is ejected occurs.

Figure 9:
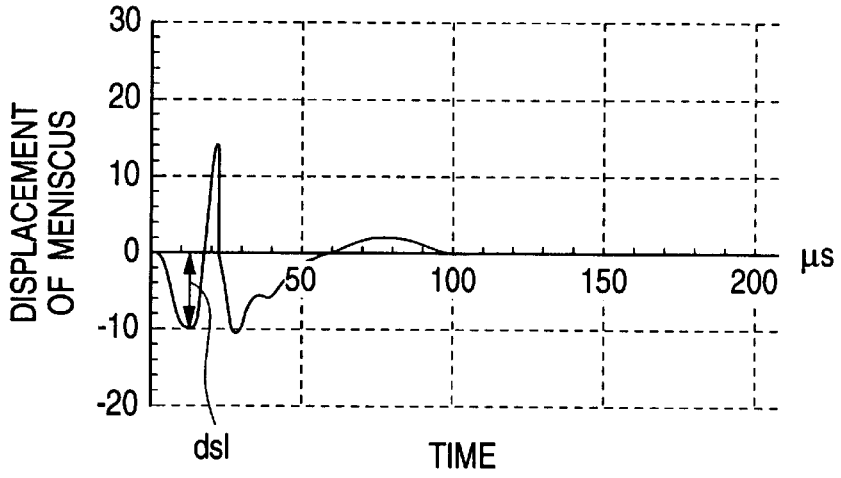
FIG. 9 is a chart showing the displacement of the meniscus when temperature is low in case a small dot is formed in the ink jet recording apparatus.
Figure 10:
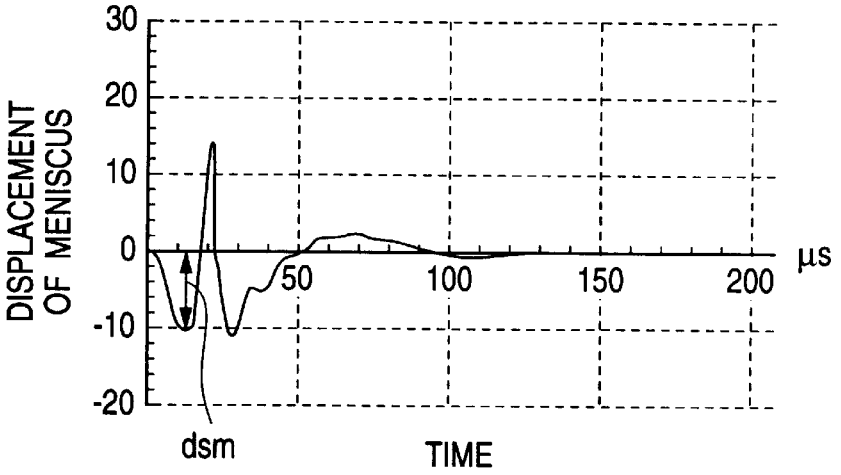
FIG. 10 is a chart showing the displacement of the meniscus at the normal temperature in case a small dot is formed in the ink jet recording apparatus.
Figure 11:
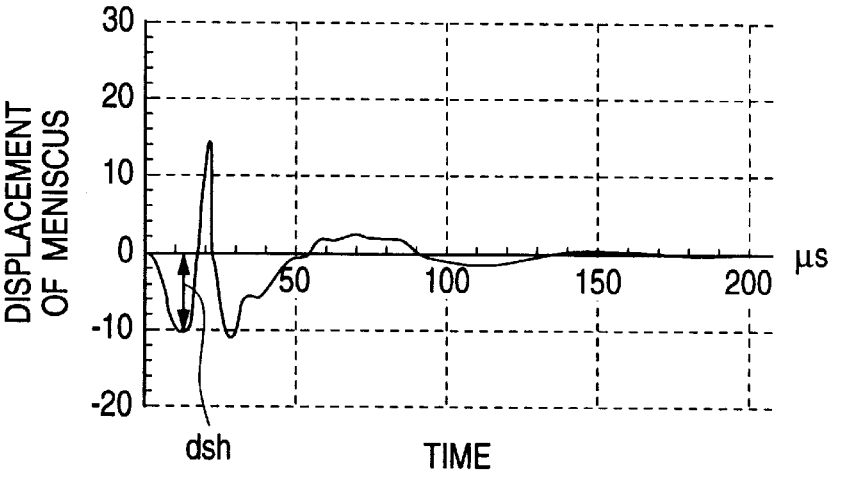
FIG. 11 is a chart showing the displacement of the meniscus when temperature is high in case a small dot is formed in the ink jet recording apparatus.

In the meantime, as the intermediate potential Vc is set to a higher value, compared with a case that a large dot is formed if an image is printed by small dots, the quantity of the expansion of the pressure generating chamber 2 according to the first signal (1) is large and therefore, the meniscus is largely drawn on the side of the pressure generating chamber 2 as shown in FIGS. 9 to 11 (ds1, dsm and dsh). As a small quantity of ink droplet is ejected by pressurizing the pressure generating chamber 2 according to the second signal (2) in addition to the motion of the meniscus, an ink droplet can be ejected at speed suitable for printing even if the maximum potential Vh is set to a low value.

That is, as the driving signal generating means 20 applies the second signal (2) for ejecting an ink droplet to the piezoelectric vibrator 4 when the vibration of the meniscus drawn in according to the first signal (1) is switched to the movement toward the nozzle aperture 9, an ink droplet is ejected by pressurization upon ink by the contraction of the pressure generating chamber 2 and the motion of the meniscus itself at higher speed than in a case where an ink droplet is ejected only by pressurization upon the pressure generating chamber 2.

As inertial force is small and the deceleration when an ink droplet is ejected increases, compared with a case where a large dot is formed because the quantity of ink in an ink droplet for forming a small dot is small, the driving signal generating member 20 compensates the decrease of ejection speed by setting the intermediate potential Vc to a larger value, compared with a case where a large dot is formed as shown in FIG. 5, in the meantime, the driving signal generating means sets the quantity compensated for temperature of the quantity of the expansion of the pressure generating chamber 2 according to the first signal (1) for the change of temperature to a smaller value, compared with a case where an ink droplet with large quantity of ink is ejected by setting the quantity of the change of potential difference between the reference potential Vs and the intermediate potential Vc for the change of temperature, that is, the incline for temperature to a small value, the restoration of the meniscus particularly when temperature is low is prevented from delaying and speed at which the pressure generating chamber is filled with ink is prevented from decreasing.

That is, if the setting of the intermediate potential Vc is too high when temperature is low in case small dot is formed, the meniscus is too largely drawn on the side of the pressure generating chamber according to the first signal, the motion of the meniscus is prevented when the meniscus is inverted toward the nozzle aperture 9 after the meniscus is drawn according to the first signal (1) also because the viscosity of ink is increased because of low temperature and blurring may occur when an ink droplet is ejected.

To avoid such problem, experiments are made, varying the value of the intermediate potential Vc and as a result, when the intermediate potential Vc is varied so that it is approximately 50 to 80% of the maximum potential Vh, preferably so that it is 60 to 70% of the maximum potential Vh in a range of temperature at which the recording apparatus can be used, it has been proven that a small dot is formed in an optimum state.

In the meantime, when the intermediate potential Vc is set so that it is approximately 30 to 70% of the maximum potential Vh and is varied in a range of 40 to 60% of the maximum potential Vh corresponding to the change of temperature if a large dot is formed, it has been proven that a large dot can be formed in an optimum state.

As the change of potential difference between the reference potential Vs and the intermediate potential Vc is smaller than the change of temperature if an ink droplet the quantity of ink in which is small is ejected, the vibration of the meniscus is hydrodynamically promptly damped because the amplitude of the vibration of the meniscus when an ink droplet is ejected is small when a small dot is formed and there is no problem practically though a function for promptly returning the meniscus after an ink droplet is ejected particularly when temperature is low toward the nozzle aperture and a function for damping the vibration of the meniscus after an ink droplet is ejected when temperature is high are deteriorated.

Figure 12:
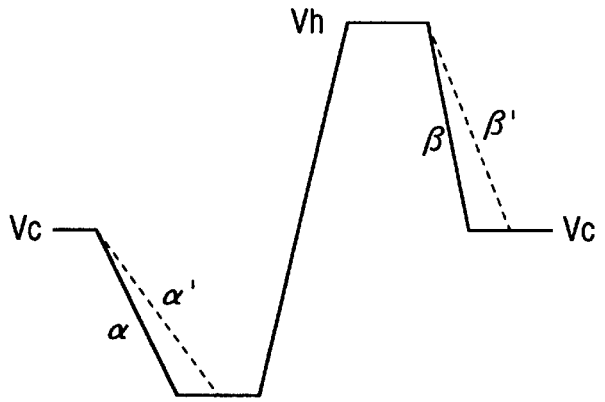
FIG. 12 shows another embodiment of the present invention in the form of the waveform of a driving signal.

In the above embodiment, quantity in which the meniscus is drawn in and force for damping the residual vibration of the meniscus after an ink droplet is ejected are controlled by controlling intermediate potential based upon potential difference between the intermediate potential and reference potential and between maximum potential and the intermediate potential, however, even if intermediate potential is fixed as shown in FIG. 12, an incline a when potential is lowered from the intermediate potential to reference potential and an incline β when the potential is lowered from maximum potential to the intermediate potential are controlled by adjusting the time constant of a trapezoidal pulse generating circuit, the similar action is produced.

That is, if ambient temperature is high, a signal with an incline α' has only to be applied to the piezoelectric vibrator 4 as the first signal, a signal with the incline β' has only to be applied as the third signal, if ambient temperature is low, a signal with the incline a has only to be applied as the first signal and a signal with an incline β' has only to be applied as the third signal.

Figure 13:
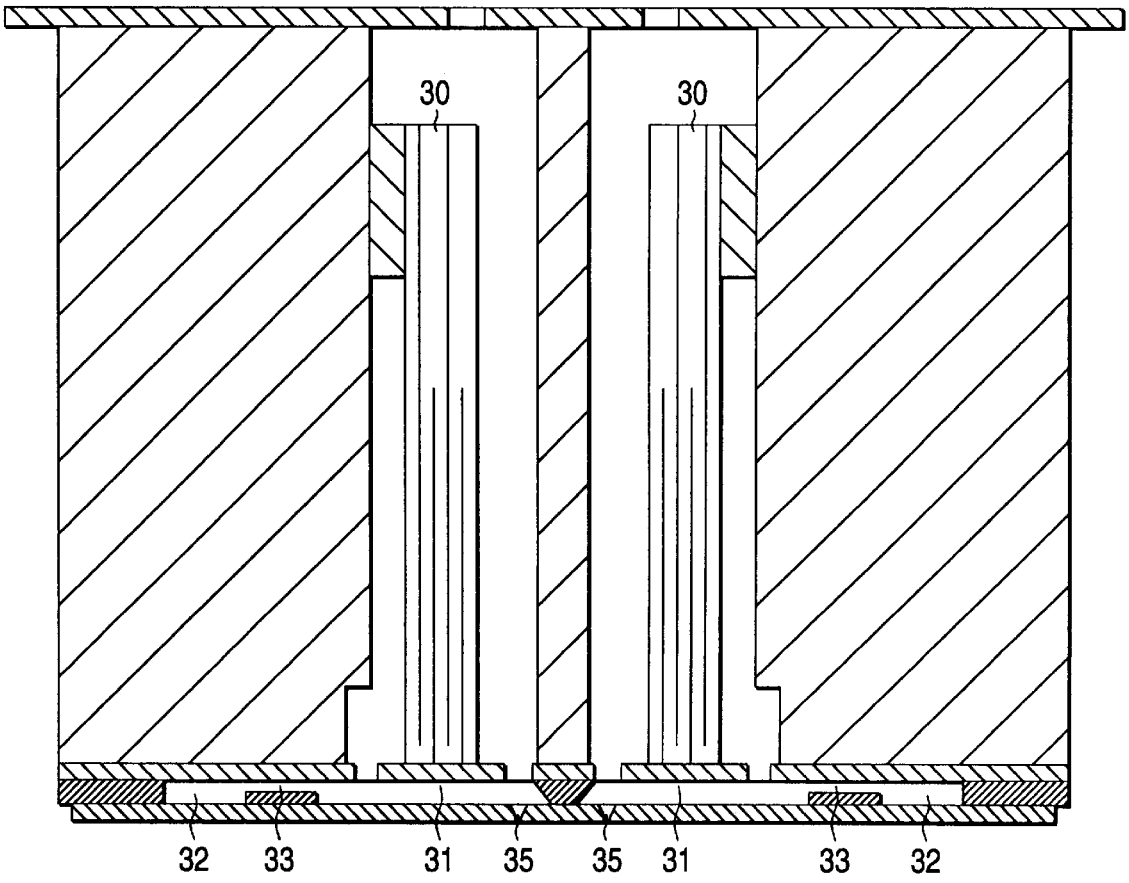
FIG. 13 is a sectional view showing an embodiment of another type of ink jet recording head to which the driving technique of the present invention can be applied.

Further, in the above embodiment, the recording head using the piezoelectric vibrator utilizing flexure as pressure generating member is described, however, even if the above embodiment is applied to the driving of a recording head in which ink in a common ink chamber 32 is supplied to a pressure generating chamber 31 via an ink supply port 33 by expanding the pressure generating chamber 31 by a piezoelectric vibrator 30 in a longitudinal vibration mode displaced in the axial direction as shown in FIG. 13 and an ink droplet is ejected from a nozzle aperture 35 by contracting the pressure generating chamber 31 by the piezoelectric vibrator 30, it is clear that the similar action is produced.

As described above, according to the present invention, as an ink jet recording head provided with a nozzle aperture, a pressure generating chamber communicating with a common ink chamber and pressure generating member for expanding or contracting the pressure generating chamber and driving signal generating member for generating a first signal for drawing a meniscus at the nozzle aperture in by smaller force as ambient temperature rises, a second signal for ejecting an ink droplet by contracting the pressure generating chamber and a third signal for restoring the contracted pressure generating chamber by larger drawing force as ambient temperature rises after an ink droplet is ejected are provided, speed at which the meniscus moves toward the nozzle aperture can be prevented from being decreased by setting force for drawing the meniscus before an ink droplet is ejected when temperature falls to a large value, the delay of filling the pressure generating chamber with ink can be prevented by setting force for drawing the meniscus after an ink droplet is ejected to a small value and damping the residual vibration of the meniscus utilizing attenuation by increasing the viscosity of ink and therefore, even a dot in particularly small size can be stably formed independent of ambient temperature.

What is claimed is:

1. An ink jet recording apparatus, comprising:

an ink jet recording head provided with a pressure generating chamber communicating with a nozzle aperture and a common ink chamber;

pressure generating means for expanding or contracting said pressure generating chamber; and driving signal generating means for generating a first signal for drawing a meniscus in said nozzle aperture by a first force, a second signal for ejecting an ink droplet by contracting said pressure generating chamber, and a third signal for expanding said pressure generating chamber, to restore said pressure generating chamber to an expansion state achieved in response to said first signal, by a second force after said ink droplet is ejected, wherein said first force is decreased and said second force is increased as ambient temperature rises.

2. An ink jet recording apparatus according to claim 1, wherein:

said pressure generating chamber includes a piezoelectric vibrator having a potential applied thereto;

said driving signal generating means generates said first signal for lowering the potential from an intermediate potential to a reference potential for expanding said pressure generating chamber, said second signal for raising the potential from said reference potential to a maximum potential for contracting said pressure generating chamber and ejecting said ink droplet, and said third signal for lowering the potential from said maximum potential to said intermediate potential after said ink droplet is ejected, for restoring said pressure generating chamber; and said intermediate potential is lowered as said ambient temperature rises such that a potential difference between said intermediate potential and said reference potential is decreased as said temperature rises.

3. An ink jet recording apparatus according to claim 2, wherein a rate of change of said intermediate potential with temperature increases as a dot size is enlarged.

4. An ink jet recording apparatus according to claim 2, wherein said intermediate potential is in a range of 30 to 80% of said maximum potential.

5. An ink jet recording apparatus according to claim 4, wherein said intermediate potential is in a range of 30 to 70% of said maximum potential for a large dot size, and said intermediate potential is in a range of 50 to 80% of said maximum potential for a small dot size.

6. An ink jet recording apparatus according to claim 2, wherein said intermediate potential is higher as a dot size is smaller.

7. An ink jet recording apparatus according to claim 1, wherein:

said pressure generating chamber includes a piezoelectric vibrator having a potential applied thereto;

said driving signal generating means generates said first signal for lowering the potential from a fixed intermediate potential to a reference potential for expanding said pressure generating chamber, said second signal for raising the potential from said reference potential to a maximum potential for contracting said pressure generating chamber and ejecting said ink droplet, and said third signal for lowering the potential from said maximum potential to said intermediate potential, after said ink droplet is ejected, for restoring said pressure generating chamber; and a rate of change of the potential in response to said first signal decreases, and a rate of change of the the potential in response to said third signal rises, as said ambient temperature rises.

8. An ink jet recording apparatus according to claim 1, wherein a size of a dot formed by said ink droplet is selected by a signal.

* * * * *

UNITED STATES PATENT AND TRADEMARK OFFICE

CERTIFICATE OF CORRECTION

PATENT NO. : 6,203,132 B1
DATED : March 20, 2001
INVENTOR(S) : Kenji Tsukada et al.

It is certified that error appears in the above-identified patent and that said Letters Patent is hereby corrected as shown below:

Column 4,
Line 18, change "Vc1" to -- Vcl --.

Column 5,
Lines 14, 51, and 52, change "Vc1" to -- Vcl --.
Line 18, change "Vc1" (both occurrences) to -- Vcl --.

Signed and Sealed this

Fifth Day of February, 2002

*Attest:*

*Attesting Officer*

JAMES E. ROGAN
*Director of the United States Patent and Trademark Office*